US005402756A

United States Patent [19]

Böhme et al.

[11] Patent Number: 5,402,756

[45] Date of Patent: Apr. 4, 1995

[54] VALVE CONTROL MECHANISM

[75] Inventors: Joachim Böhme, Lichtenwalde; Leopold Müller, Chemnitz; Frank Schwabe, Rodewisch, all of Germany

[73] Assignee: LAV Motor GmbH, Chemnitz, Germany

[21] Appl. No.: 152,283

[22] Filed: Nov. 12, 1993

[30] Foreign Application Priority Data

Nov. 13, 1992 [DE] Germany ..... 42 38 325
Oct. 18, 1993 [DE] Germany ..... 43 35 431

[51] Int. Cl.[6] ..... F01L 1/14; F02D 13/06

[52] U.S. Cl. ..... 123/90.16; 123/90.48; 123/198 F

[58] Field of Search ..... 123/90.15, 90.16, 90.17, 123/90.48, 198 F

[56] References Cited

U.S. PATENT DOCUMENTS 4,141,333 2/1979 Gilbert ..... 123/90.16
4,905,639 3/1990 Konno ..... 123/90.16
5,090,364 2/1992 McCarroll et al. ..... 123/90.48
5,193,496 3/1993 Kruger ..... 123/90.16
5,253,621 10/1993 Dopson et al. ..... 123/90.16
5,287,830 2/1994 Dopson et al. ..... 123/90.16

*Primary Examiner*—Willis R. Wolfe
*Assistant Examiner*—Weilun Lo
*Attorney, Agent, or Firm*—Collard & Roe

[57] ABSTRACT

An apparatus for controlling the engagement between a cam and a push rod in an internal combustion engine for affecting operation of a valve. The apparatus includes an outer tappet engaging the cam. A central tappet is connected to the push rod and supported within the outer tappet. A tappet coupling member is disposed between the outer tappet and the central tappet. A locking element is slidable between an unlocked position where the outer tappet moves freely with respect to the central tappet and a locked position, where the outer tappet is locked to the central tappet for moving the push rod to open the valve.

6 Claims, 5 Drawing Sheets

VALVE CONTROL MECHANISM

BACKGROUND OF THE INVENTION

1. Field of the Invention

The present invention relates to a valve control mechanism for an internal combustion engine. More specifically, it relates to a valve control mechanism for switching control of the valve between two different cams or for keeping the valve closed.

2. Prior Art

Valve control systems are known, for example, from U.S. Pat. No. 5,090,364 for use with overhead camshafts and underhead camshaft and push rods. This valve design has a tappet element that can be switched on or off with respect to its action on the valve stroke. The tappet element is axially slidable in the direction of reciprocation of the valve train. In each case, a driver device is arranged between the push rod and the tappet element. The drive device can be switched on and off and may have different designs. FIGS. 8 to 12 of the patent specification show an arrangement of a tappet for two valves to be actuated in parallel. The driver device has balls as drivers for alternatively changing between two cams with different profiles.

This mechanical driver device is arranged between an outer tappet engaging both valves, and a central tappet slidable within the outer tappet. The two tappets can be coupled together by the driver device. When the driver device is inactive, a small stroke is transmitted to the valves by a first cam having two halves. When the driver device is active, a larger stroke is transmitted to the valves by a second cam arranged between the halves of the first cam.

The driver device has ball bearings, which are supported in a central guide of the outer tappet and which are slidable radially outwardly. The ball bearings can be engaged with an inwardly inclined annular surface on the central tappet, with the surface being averted from the camshaft. The displacement and holding of the balls in the engaged position take place by means of a locking slide, which is slidable against a spring force against the axial direction of reciprocation by admission of pressure, and which is concentrically guided in the central guide of the outer tappet.

A driver device of the type described above, with a locking element that is arranged in the center and axially slidable in the direction of reciprocation and always acted upon by spring force, is disadvantageous because of the forces resulting from movement with their acceleration and delays, and also the spring force acts on the locking element against the hydraulic controlling force.

Therefore, it would be desirable to provide a valve control mechanism that is self-locking in the engaged condition and where the locking slides of the driver device remain unaffected by forces resulting from the reciprocation and by constantly acting spring forces.

SUMMARY OF THE INVENTION

Therefore it is an object of the present invention to overcome the drawbacks of the prior art and to provide a valve control mechanism that is simple in design and reliable in operation.

It is a further object of the present invention to provide a valve control mechanism that remains engaged and is unaffected by the movement of the push rod along the cam.

It is a further object of the present invention to provide a valve control mechanism where the locking element is moved by varying the pressure on either side of the locking element.

It is still a further object of the present invention to provide a valve control mechanism that remains safely engaged even when the pressure on either side of the locking element fluctuates slightly.

It is another object of the present invention to provide a valve control mechanism that is disposed in the rocker arm where it connects to the push rod.

These and other related objects are achieved according to the invention by an apparatus for controlling the engagement between a cam and a push rod in an internal combustion engine for affecting operation of a valve. The apparatus includes an outer tappet engaging the cam and a central tappet connected to the push rod and supported within the outer tappet. The central tappet and the push rod have a common central axis. A tappet coupling member is disposed between the outer tappet and the central tappet. A locking element is selectively slidable in a plane perpendicular to the central axis between an unlocked position where the outer tappet moves freely with respect to the central tappet and a lock position where the locking element and the tappet coupling member couples the outer tappet to the central tappet for moving the push rod to open the valve.

A pressurized controller slides the locking element between the unlocked and the locked position. The outer tappet includes a pocket facing the central tappet. The central tappet includes an aperture adapted for alignment with the pocket. The tappet coupling member comprises a ball residing at least partially within the aperture. The locking element moves the ball into the pocket to lock the outer tappet to the central tappet for movement together. The locking element comprises a spool selectively hydraulically operated. The spool includes a recess for partially receiving the ball and a sloped surface for camming the ball into the pocket upon hydraulic operation of the spool.

In an alternate embodiment, the apparatus controls the engagement between two cams and a push rod, where the two cams have different profiles from each other. The apparatus includes an outer tappet engaging one of the cams and including a bore. A central tappet is connected to the push rod and mounted in the bore for reciprocating movement therein and for engaging the other cam. In a first unlocked position the outer tappet moves freely with respect to the central tappet and the push rod moves according to the profile of the cam engaging the central tappet. In a second locked position, the locking element and the tappet coupling member couples the outer tappet to the central tappet, whereby the push rod moves according to the profile of the cam engaging the outer tappet.

The outer tappet has spaced-apart cam contact portions on opposite sides of the bore. The cam engaging the central tappet comprises a single cam. The cam engaging the outer tappet comprises a pair of cams on either side of the single cam for engaging the spaced-apart cam contact portions. The single cam has a lower overall profile than the pair of cams. The single cam is cylindrical and concentrically oriented with respect to a central axis of the camshaft.

In a further embodiment the apparatus controls the engagement between a push rod and a rocker arm. The apparatus includes a tappet connected to the push rod and supported within the rocker arm. A locking device is slidably disposed between the tappet and the rocker arm for selectively coupling the tappet to the rocker arm. The tappet and the push rod have a common central axis with the locking device being slidable in a plane perpendicular to the central axis. A pressurized controller controls sliding movement of the locking device. The locking device comprises a coupling member and a locking bar, with the locking bar having a curved surface for selective engagement with the coupling member. The coupling member is a ball configured and dimensioned to fit against the curved surface of the locking bar.

BRIEF DESCRIPTION OF THE DRAWINGS

Other objects and features of the present invention will become apparent from the following detailed description considered in connection with the accompanying drawings, which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENT

Figure 1:
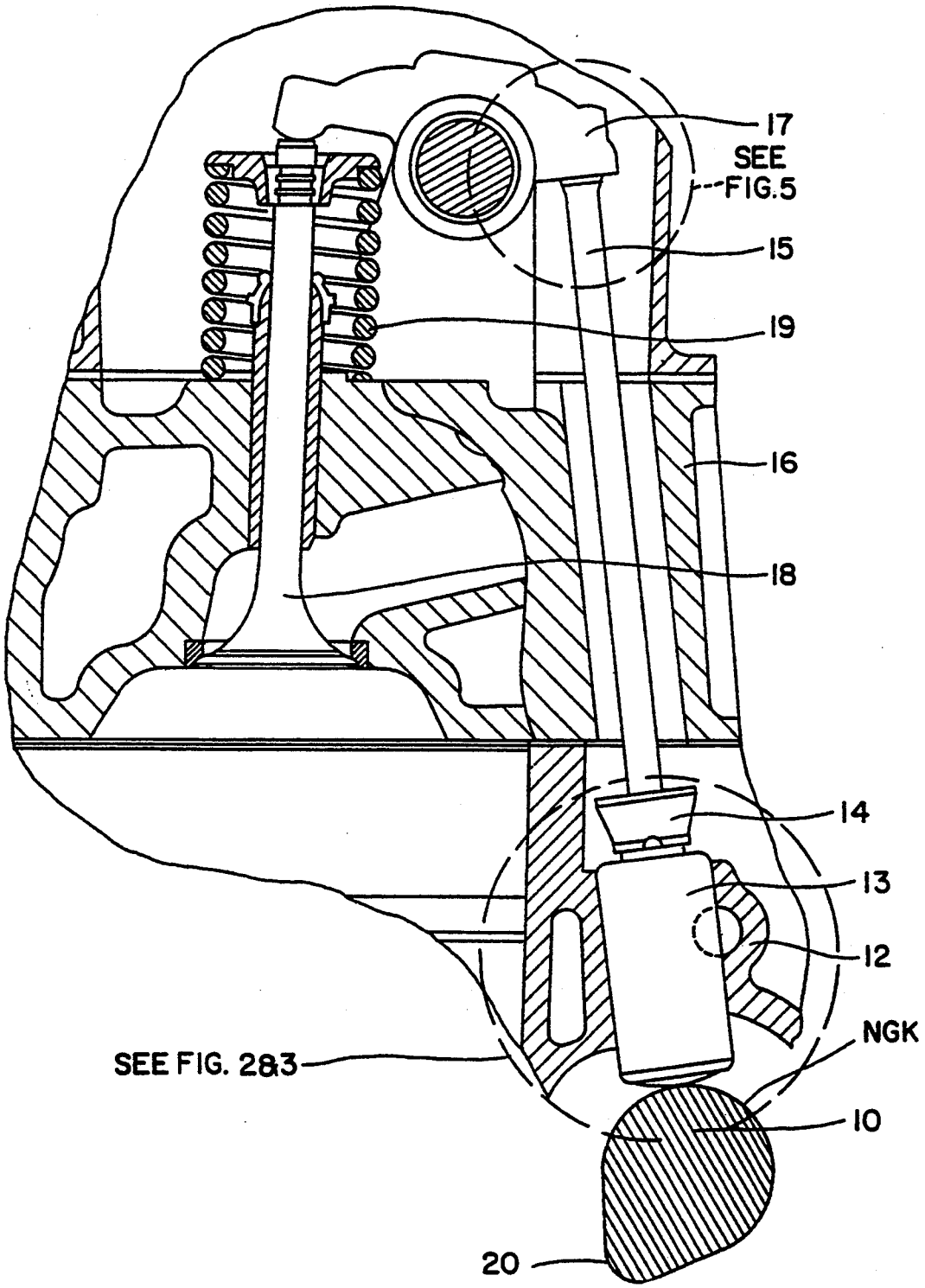
FIG. 1 is a side-elevational view, in part cross section, of an embodiment of a valve train according to the invention.

FIG. 1 shows a valve train an underhead camshaft 10. An outer tappet 13 is supported in a cylinder block 12 and contacts a support head 14 of push rod 15 and cam 20. A rocker arm 17 is supported by a cylinder head 16 for transferring motion of push rod 15 to a valve 18 against valve spring 19. The valve train is adapted for selective engagement between the camshaft and the valve. One such arrangement is disclosed in U.S. Pat. No. 5,090,364, the subject matter of which is incorporated herein by reference thereto.

Figure 2:
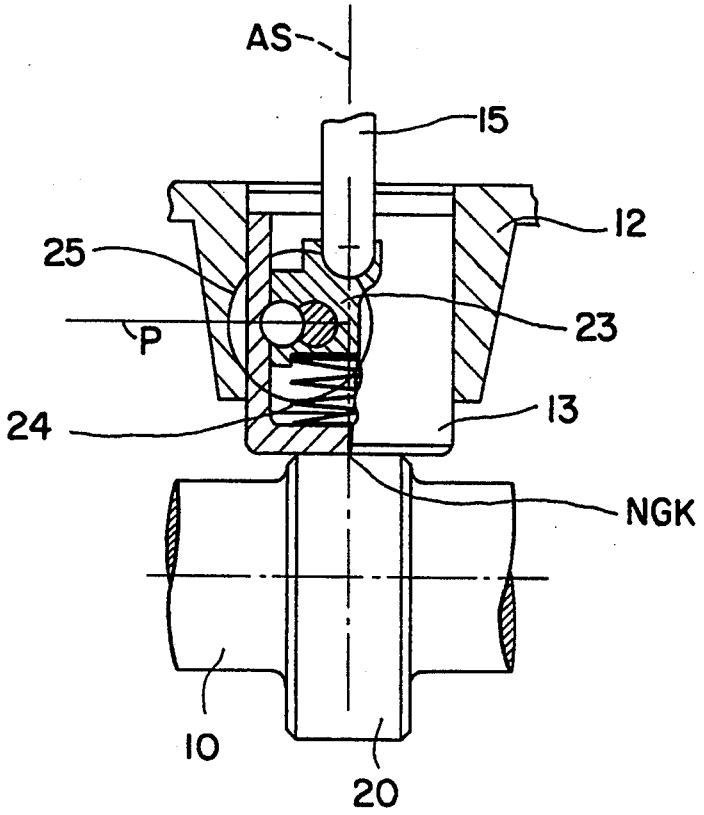
FIG. 2 is an enlarged right side-elevational view, in part cross section, of a lower tappet from FIG. 1.

FIG. 2 shows outer tappet 13 engaged with cam 20 of camshaft 10. A central tappet 23 is part of a driver device 25 formed by tappet coupling members or drivers 26 and locking bodies or elements 17. Central tappet 23 is slidably supported within outer tappet 13. When passing through the basic cam circle "NGK", drivers 26, for example, ball bearings, face the guide bore or concave counter-contours, e.g., depressions or grooves 28 of outer tappet 13. Drivers 26 are displaceable into grooves 28 by means of locking bodies 27.

When drivers 26 engage grooves 28 of outer tappet 13, the stroke of cam 20 is transmitted to valve 18. When drivers 26 are not engaged, outer tappet 13 executes an idle stroke against spring 24 counter-supported on central tappet 23 and, if need be, against a second spring, not shown for the sake of clarity, supported in the cylinder block. When drivers 26 are not engaged, outer tappet 13 is only connected to central tappet 23, push rod 75 and the remainder of the valve train by spring 24. Therefore, movement of outer tappet 13 against cam 20 does not open valve 18. Only when drivers 26 are engaged is outer tappet 13 positively connected to central tappet 23 and the remainder of the valve train whereby movement of outer tappet 13 is transmitted to valve 18.

Figure 3A:
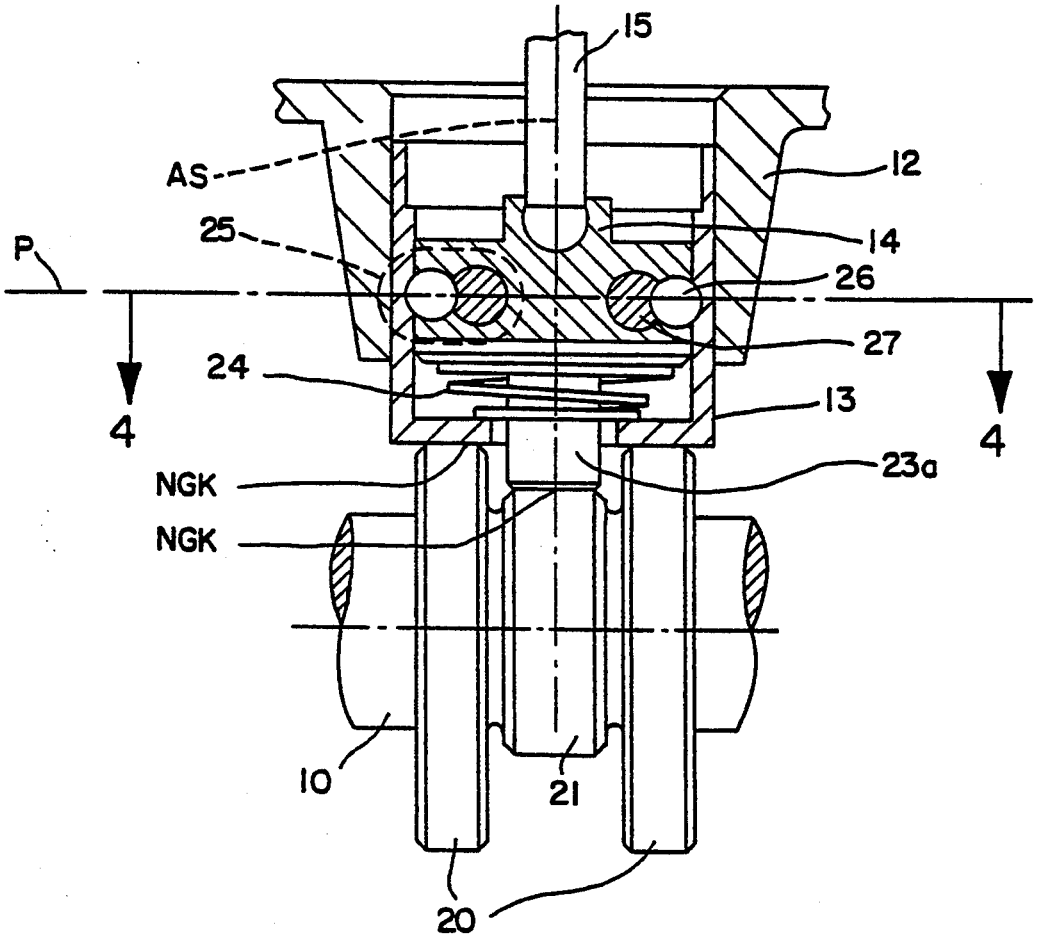
FIG. 3A is an enlarged right side-elevational view, in part cross section, of an alternate embodiment of the lower tappet from FIG. 1.

FIG. 3A shows an alternate embodiment of the invention where central tappet **23*a* penetrates outer tappet 73 and, when the drive device 25 is inactive, central tappet 23*a* is constantly in engagement with cam 21. Cam 21 has a lower overall profile compared to cam 20, which stroke is transmitted to valve 18 in the above-described condition. Tappet 13 moves idle against spring 24 supported on central tappet 23*a* and, if need be, against another spring (not shown) counter-supported in cylinder block 12. When driver device 25 is switched on, the greater profile of cam 20 is transmitted to valve 18 via tappet 23*a* and the valve train while central tappet 23*a* is disengaged from cam 21**.

Driver device 25 can always be switched on when passing through the range of the parallel basic cam circle "NGK" of cams 20 and 21. In this range, drivers 26 and counter-contours are facing one another in a suitable way for producing the engagement.

Figure 3B:
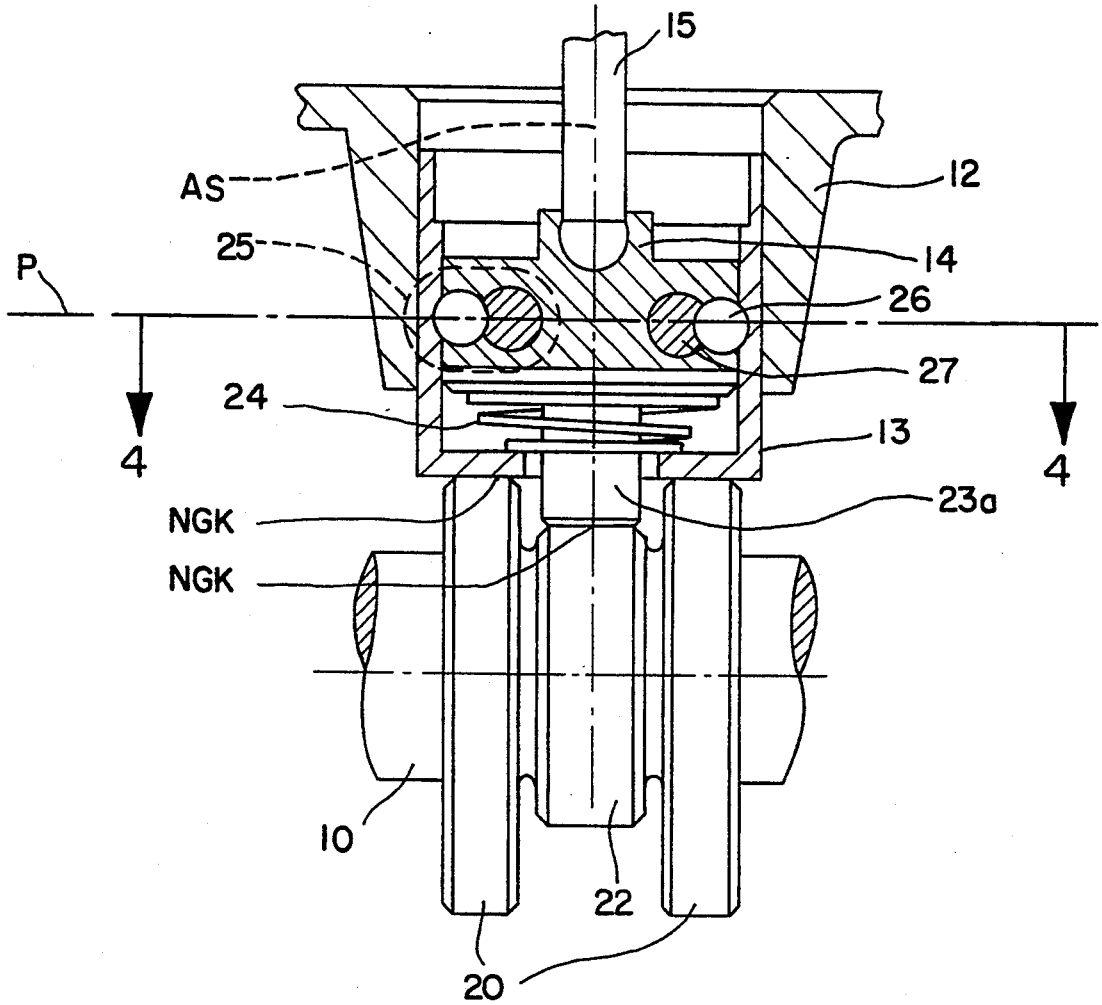
FIG. 3B is an enlarged right side elevational view, in part cross section, of a further embodiment of the lower tappet from FIG. 1.

According to FIG. 3B, a design is possible in connection with which cam 21 is a circular raised portion or a cylindrical disk 22 and is mounted concentrically on camshaft 10. A valve shut-off is thus realized when driver 25 is disengaged.

When driver device 25 is active, a transmission of the stroke takes place from cam 20 to valve 18 via outer tappet 13. Central tappet **23*a* is not in contact with cam 21 or 22. With driver device 25 in the inactive condition, tappet element 23*a* rests on cam 21 or disk 22, whereas outer tappet 13 executes an idle stroke against spring 24** or against a spring supported on the motor block. No stroke of the valve takes place.

Figure 5:
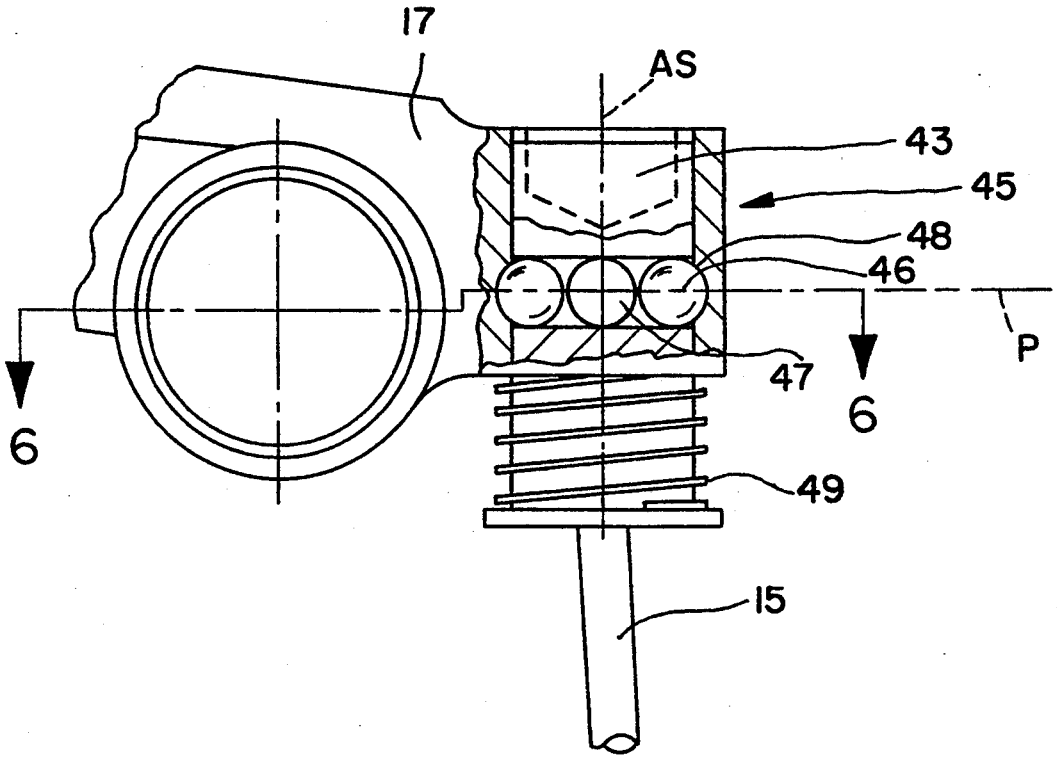
FIG. 5 is an enlarged side-elevational view, in part cross section, of an upper tappet in a rocker arm from FIG. 1.

FIG. 5 shows a valve train with the valve control mechanism of the invention in rocker arm 17. In the usual way, the valve stroke is transmitted from cam 20 via the valve train—outer tappet 13, support head 14, push rod 15—to upper tappet element 43, which is slidably supported in rocker arm 17.

Driver device 45 is arranged between upper tappet 43 and rocker arm 17 which, in the inactive condition, effects a valve switch-off. In this case, upper tappet 43 moves idle against the force of spring 49 supported on rocker arm 17, whereby rocker arm 17 engages valve 18 without effecting a stroke.

Driver device 45 can always be switched on when passing through the lowest point of the cam circle "NGK" of cam 20. In this range then, drivers 46 and counter-contours 48 face each other in a suitable way for upper tappet 43 and rocker arm 17 to engage.

When driver device 45 is active, rocker arm 17 moves in accordance with the cam stroke, driven by upper tappet 43, and opens valve 18.

Figure 4:
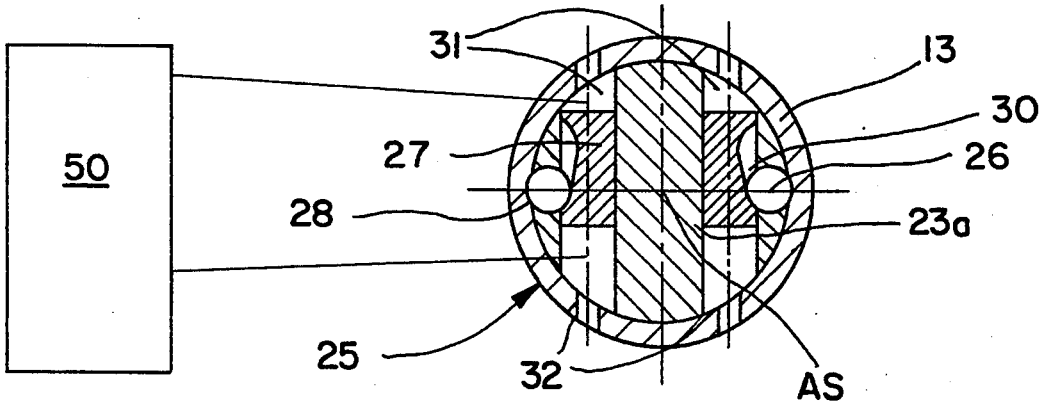
FIG. 4 is a cross-sectional view taken along the line 4—4 from FIG. 3.
Figure 6:
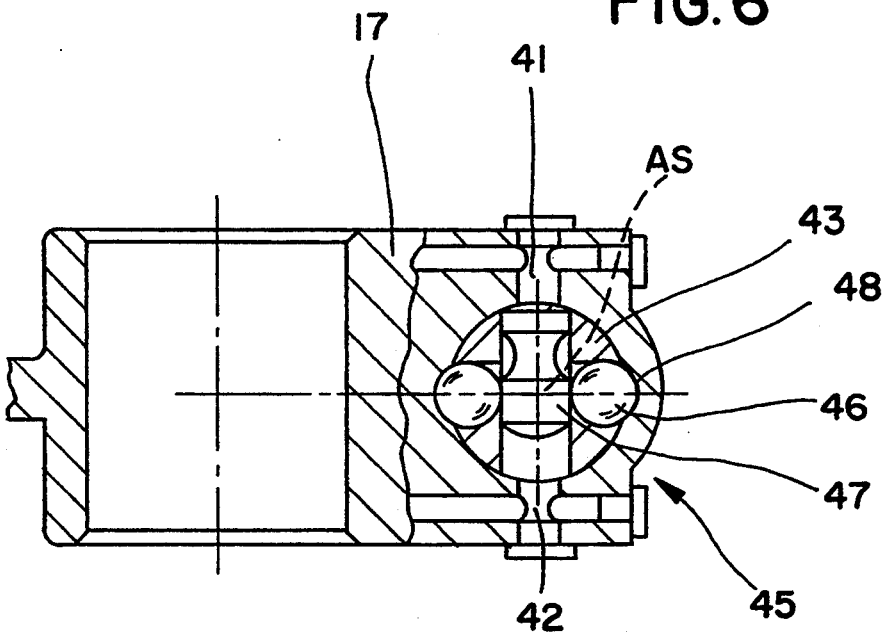
FIG. 6 is a cross-sectional view taken along the line 6—6 from FIG. 5.

As can be seen in FIGS. 4 and 6, driver devices 25 and 45 have a basically similar structure. At least two drivers 26 and 46 are supported in one of the two adjacent stroke transmission elements—tappet 13 and toggle lever 17, respectively, or tappet elements 23*a* and 43, respectively—and the associated counter-contours 28 and 48 in the other elements of the valve train. In this connection, for engaging drivers 26 and 46, locking bodies 27 and 47 are arranged in each case between said elements in a plane extending transversely to the axis AS. Locking bodies 27 and 47 are slidably disposed within transverse channels having ends 31 and 32 and 41 and 42, respectively. The channels are ideally disposed within tappets 23 and 43, although other configurations are possible. Locking bodies are slid transversely within the channels and held in place by alternately pressurizing ends 31 and 32 and 41 and 42 of the channels through oil ducts. On account of said arrangement, locking bodies 27 and 47 remain unaffected by the acceleration and de-acceleration forces of the reciprocating movement of the valve train.

When ends 31 and 41 are pressurized and ends 32 and 42 are depressurized, locking bodies 27 and 47 are shifted toward ends 32 and 42 and drivers 16 and 46 are disengaged as they are free to move within the recesses in locking bodies 27 and 47.

When ends 32 and 42 are pressurized and ends 31 and 41 are depressurized, locking bodies 27 and 47 are shifted toward ends 31 and 41. Drivers 16 and 46 are forced outwardly and engage counter-contours 28 and 48 when passing through the lowest point of the cam circle or circles "NGK" of cam 20 or cams 20 and 21, as shown in FIG. 2. Ends 31, 41 and 32, 42 are alternately pressurized and depressurized by a pressurized controller 50, for example, an hydraulic controller.

Furthermore, driver devices with externally disposed locking bodies and drivers that have to be engaged inwardly, or with drivers which are slidable into engagement directly tangentially are contemplated by the invention.

While several embodiments of the present invention have been shown and described, it is to be understood that many changes and modifications may be made thereunto without departing from the spirit and scope of the invention as defined in the appended claims.

What is claimed is:

1. An apparatus for controlling the engagement between two disks of a camshaft and a push rod in an internal combustion engine for affecting operation of a valve, the two disks having different profiles from each other, the apparatus comprising:

an outer tappet engaging one of the disks, said outer tappet having a bore;

a central tappet connected to the push rod and mounted in the bore for engaging the other disk, the central tappet and the push rod having a common central axis and reciprocating along the common central axis;

a tappet coupling member disposed between the outer tappet and the central tappet;

a locking element disposed within a channel extending perpendicular to said central axis, the channel having two spaced opposite ends that are alternately hydraulically pressurized for sliding said locking element between (i) a first position, wherein said outer tappet moves freely with respect to said central tappet and the push rod moves according to the profile of the disk engaging said central tappet; and (ii) a second position, wherein said locking element and said tappet coupling member couple said outer tappet to said central tappet, whereby the push rod moves according to the profile at the disk engaging said outer tappet;

wherein said locking element remains in said positions unaffected by the reciprocation of said tappets, hydraulic pressure variations and gas bubbles within the hydraulic medium.

2. The apparatus according to claim 1, wherein said outer tappet has spaced apart cam contact portions on opposite sides of the bore;

the disk engaging said central tappet comprising a single disk;

the disk engaging said outer tappet comprises a pair of cams on either side of said single disk for engaging said spaced apart cam contact portions.

3. The apparatus according to claim 2, wherein the single disk engaging said central tappet has a lower overall profile than the pair of cams engaging said outer tappet.

4. The apparatus according to claim 3, wherein said outer tappet includes a pocket facing said central tappet;

said central tappet includes an aperture adapted for alignment with the pocket;

said tappet coupling member comprising a ball residing at least partially within the aperture; and wherein said locking element moving said ball into the pocket to lock said outer tappet to said central tappet for movement together.

5. The apparatus according to claim 4, wherein said locking element comprises a spool including a recess for partially receiving said ball and a sloped surface for camming said ball into the pocket upon hydraulic operation of said spool.

6. The apparatus according to claim 5, wherein the single disk engaging said central tappet has a circular axial cross section and is concentrically oriented with respect to a central axis of the camshaft.

* * * * *